US006868990B2

(12) United States Patent
Cater et al.

(10) Patent No.: US 6,868,990 B2
(45) Date of Patent: Mar. 22, 2005

(54) FLUID DISPENSER WITH SHUTTLING MIXING CHAMBER

(75) Inventors: Miro Cater, Daytona Beach, FL (US); Fabrizio Camplone, Pescara (IT)

(73) Assignee: Emsar, Inc., Stratford, CT (US)

( * ) Notice: Subject to any disclaimer, the term of this patent is extended or adjusted under 35 U.S.C. 154(b) by 86 days.

(21) Appl. No.: 10/254,791

(22) Filed: Sep. 26, 2002

(65) Prior Publication Data

US 2004/0060945 A1 Apr. 1, 2004

(51) Int. Cl.[7] ..... B67D 5/58

(52) U.S. Cl. ..... 222/190; 222/145.5; 222/189.09; 222/213

(58) Field of Search ..... 222/92, 95, 1, 222/107, 190, 145.5, 145.6, 189.06, 189.09, 189.1, 206–215, 481.5, 482, 484, 522–523, 531

(56) References Cited

U.S. PATENT DOCUMENTS

| | | | | |
|---|---|---|---|---|
| 3,493,179 A | * | 2/1970 | Lee | 239/327 |
| 3,709,437 A | | 1/1973 | Wright | |
| 3,937,364 A | | 2/1976 | Wright | |
| 4,044,923 A | | 8/1977 | Gardner | |
| 4,147,306 A | | 4/1979 | Bennett | |
| 4,156,505 A | | 5/1979 | Bennett | |
| 4,350,298 A | | 9/1982 | Tada | |
| 4,440,320 A | | 4/1984 | Wernicke | |
| 4,531,659 A | | 7/1985 | Wright | |
| 4,596,343 A | | 6/1986 | Ford, Jr. | |
| 4,615,467 A | | 10/1986 | Grogan et al. | |
| 4,640,440 A | | 2/1987 | Ford, Jr. et al. | |
| 4,673,110 A | * | 6/1987 | Workum | 222/211 |
| 4,773,570 A | * | 9/1988 | Workum | 222/190 |
| 4,836,422 A | | 6/1989 | Rosenberg | |
| 4,846,376 A | | 7/1989 | Palmer | |
| 4,880,161 A | | 11/1989 | Wright | |
| 4,913,317 A | | 4/1990 | Wernicke | |
| 5,033,654 A | | 7/1991 | Bennett | |
| 5,037,006 A | | 8/1991 | Kock | |
| 5,048,750 A | | 9/1991 | Tobler | |
| 5,052,585 A | | 10/1991 | Bolduc | |
| 5,054,688 A | | 10/1991 | Grindley | |
| 5,064,103 A | | 11/1991 | Bennett | |
| 5,071,379 A | | 12/1991 | Poizot | |
| 5,143,717 A | | 9/1992 | Davis | |
| 5,156,307 A | | 10/1992 | Callahan et al. | |
| 5,180,082 A | | 1/1993 | Cherfane | |
| 5,193,264 A | | 3/1993 | Brown | |
| 5,219,102 A | * | 6/1993 | Wright | 222/190 |
| 5,255,851 A | | 10/1993 | Tobler | |
| 5,310,093 A | | 5/1994 | Bennett | |
| 5,390,829 A | * | 2/1995 | Saito et al. | 222/321.8 |
| 5,409,136 A | * | 4/1995 | Workum | 222/1 |

(List continued on next page.)

FOREIGN PATENT DOCUMENTS

| | | |
|---|---|---|
| DE | 199 51 011 | 5/2001 |
| EP | 0 570 728 | 9/1994 |
| EP | 1 190 775 | 3/2002 |
| WO | WO91/14648 | 10/1991 |
| WO | WO94/28759 | 12/1994 |
| WO | WO95/26831 | 10/1995 |
| WO | WO01/30508 | 10/1999 |
| WO | WO99/49769 | 10/1999 |
| WO | WO99/50037 | 10/1999 |
| WO | WO01/85356 | 11/2001 |

*Primary Examiner*—Frederick Nicolas
(74) *Attorney, Agent, or Firm*—Kenyon & Kenyon

(57) ABSTRACT

The invention relates generally to a foam dispenser having a reservoir, a housing, and a chamber. The reservoir delivers fluid to the housing and the chamber through a dip-tube. The chamber moves within the housing in response to fluid pressure or air pressure from the reservoir, allowing air and foamable liquid to enter the chamber. Foam-producing packing material inside the chamber causes the air and foamable liquid to mix and produce foam.

18 Claims, 8 Drawing Sheets

U.S. PATENT DOCUMENTS 5,411,177 A 5/1995 Blake, III
5,443,569 A * 8/1995 Uehira et al. ..... 222/190
5,445,288 A 8/1995 Banks
5,570,819 A 11/1996 Uehira et al. ..... 222/190
5,725,129 A 3/1998 Chapin et al.
5,725,155 A 3/1998 Grunenberg et al.
5,813,785 A 9/1998 Baudin et al.
5,842,607 A 12/1998 Snider
6,053,369 A 4/2000 Hoang et al.
6,056,160 A 5/2000 Carlucci et al.
6,082,586 A 7/2000 Banks
6,394,315 B1 5/2002 Banks
6,669,056 B2 * 12/2003 Bistolfi ..... 222/145.6

* cited by examiner

125

FLUID DISPENSER WITH SHUTTLING MIXING CHAMBER

FIELD OF THE INVENTION

The invention relates to a fluid dispenser, and more specifically to a foam dispenser capable of combining air and a foamable liquid to produce foam.

BACKGROUND

Foam dispensers fall into two general categories: hand-held squeeze bottles and foam aerosols. Hand-held squeeze bottles are non-aerosol foam dispensers. When squeezed, foam is produced by the mixing of flowing streams of foamable liquid and air in a distinct mixing area. Foam is produced when these flowing streams are absorbed into a sponge-like foam producing element. The hand-held squeeze bottles typically use a different path for air reentry into the bottle than the path used for dispensing foam. These bottles have drawbacks, however, because they are designed to be handheld operated and must therefore be limited in size. Hand-held squeeze bottles also suffer from the disadvantage that the foamable liquid can leak out of the bottle if the bottle is not held upright. Another common disadvantage of the hand-held squeeze bottles is that they fail to replenish the reservoir bottle with adequate amount of air. As a result, the reservoir has a disproportionate amount of foamable liquid to air and is, therefore, unable to produce suitable foam.

For example, U.S. Pat. No. 5,033,654 to Bennett discloses a foam dispenser having a deformable reservoir of foamable liquid and air and a foam producing segment that includes a foam filter. When the foam dispenser is operated, air from the inside of the reservoir mixes with the foamable liquid to produce foam. To replenish air back into the reservoir after foam has been dispensed, a check valve in the form of a moving ball within a cylinder is used. The check valve is disposed outside the foam's flow path. The patent discloses that when the deformable reservoir is squeezed, the walls of the reservoir bottle collapse causing air in the reservoir to push the ball against one end of the cylindrical thereby obstructing the passage of air from the check valve. Immediately after dispensing foam, during the so-called relaxation stage, the elastic walls of the reservoir bottle revert back to their original shape and create a relative vacuum. The back pressure causes the ball of the check valve to drop from one end of the cylindrical housing to the other end allowing ambient air to replenish the reservoir. Because the plastic container used as the reservoir is relatively weak, it can only offer modest restorative forces. For example, a typical container may be able to create as little as 0.5 psi of vacuum as it returns to its original shape. In addition, once the ball is seated against the end of the cylindrical housing, the air path into the reservoir is at least partially obstructed. As a result, this and similar designs fail to timely and adequately replenish the reservoir with air. The relatively slow re-fill, or replenishment of air, fails to return the bottle to its original size. Consequently, most of its volume may consist of liquid. The next squeeze produces improper air/fluid ratio thus degrading the quality of foam, and in worst cases, only liquid (thus no foam). In the absence of an adequate amount of air in the reservoir foam production will be hampered.

Another important requirement of the air refill method is the effectiveness during the dispensing stroke. If during dispensing stroke air escapes from the refill passage, then less foam would be produced and dispensed.

Aerosol foam dispensers overcome only some of the problems of hand-held squeeze bottles. In foam aerosols, pressurized hydrocarbon gases, and in the past fluorocarbon gases as well, drive the active substances out of a reservoir. Aerosols, however, have other drawbacks. Fluorocarbons have been rejected for environmental reasons and hydrocarbons are unsafe due to inflammability. Safe propellants aimed at remedying these concerns include compressible gases such as nitrogen or compressed air. These safe propellants, however, are not as dissolvable in liquid active substances as hydrocarbons. This makes it difficult with these safer propellants to keep the pressure sufficiently high and maintain effective spraying as the active substances are consumed. Moreover, it is difficult with such propellants to obtain useful aerosol foams from conventional valve and dispenser head combinations.

Thus, there is a need for foam dispenser that can provide timely and effective air refill while providing a hermetic seal during storage and transport.

SUMMARY OF THE INVENTION

These and other disadvantages are addressed by the various embodiments of the present invention. In one embodiment, the dispensing apparatus includes a reservoir for containing air and a foamable liquid, a housing coupled with the reservoir, and a chamber moveably disposed within the housing. The chamber can move within the housing from a first position to a second position in response to the pressure difference between the reservoir's internal pressure and the ambient pressure. When in the first position, the chamber and the housing form a first inlet for communicating air between the atmosphere and the reservoir. In the second position, the chamber and the housing seal the first inlet and form a second inlet that allows the chamber to receive air and foamable liquid from the reservoir. Packing material or filters can be placed inside the chamber to provide sufficient surface area to mix the air and the foamable liquid.

The invention also provides a method for mixing at least two fluids. In one embodiment, the invention provides a method for producing foam by displacing a quantity of air and foamable liquid from the reservoir into the chamber, mixing air with foamable liquid inside the chamber to produce foam, and dispensing the foam from the chamber.

The foam dispenser of the invention is advantageous over the conventional foam dispensers because it is able to fully and timely replenish the reservoir's air supply after air has been dispensed along with foam.

BRIEF DESCRIPTION OF THE DRAWINGS

The various features of the invention will best be appreciated by simultaneous reference to the description that follows and the accompanying drawings, wherein like numerals indicate like elements, and in which.

DETAILED DESCRIPTION OF THE EMBODIMENTS OF THE INVENTION

Figure 1:
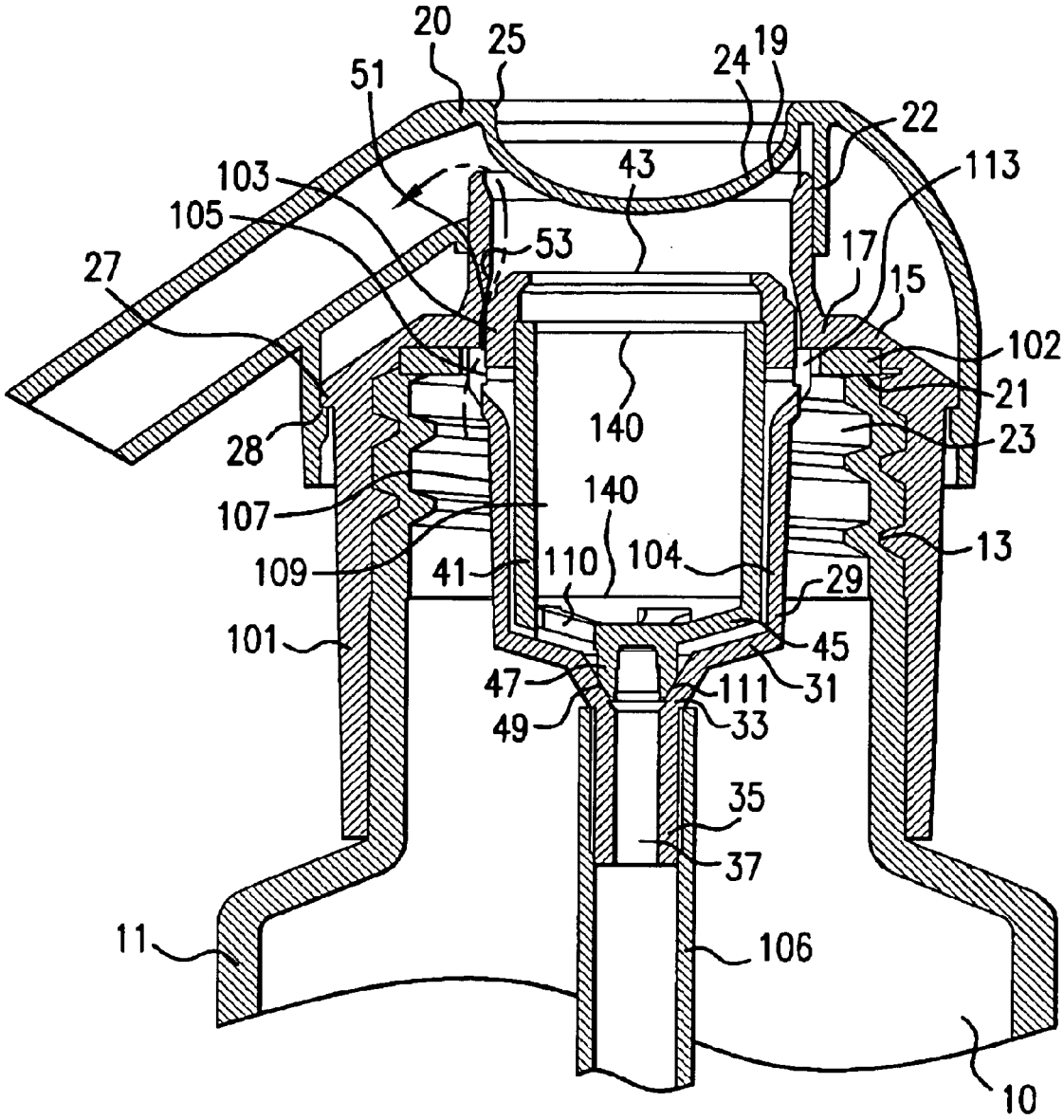
FIG. 1 is a cross-sectional view of an apparatus in accordance with one embodiment of the invention.
Figure 2:
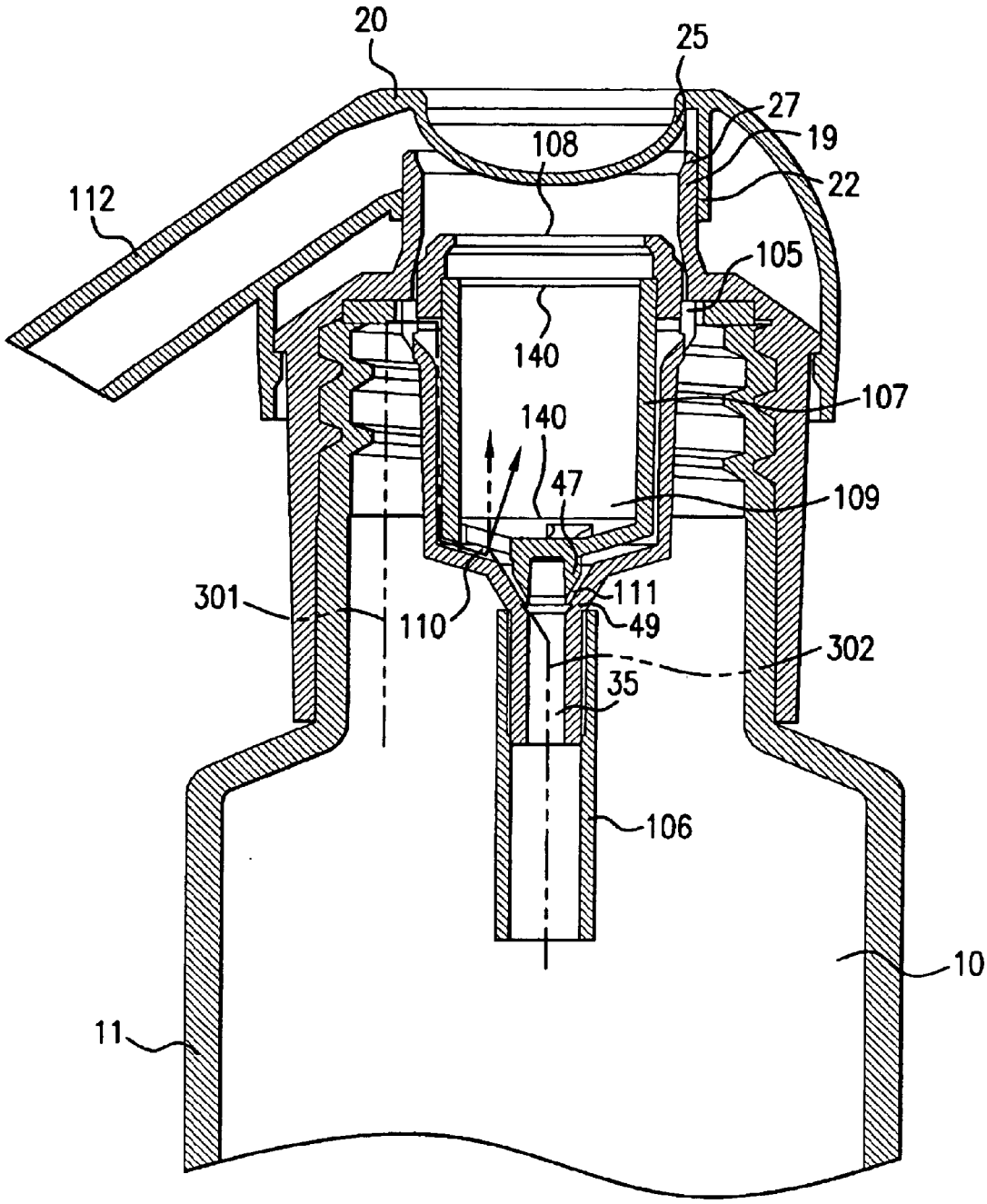
FIG. 2 is a cross-sectional view of the apparatus of FIG. 1 while the apparatus is in use.

It should be noted that while the invention is discussed in reference to FIGS. 1 and 2, the apparatus and the method of the invention are not limited thereto.

FIG. 1 illustrates a cross-sectional view of an apparatus in accordance with one embodiment of the invention in re-fill position. In this embodiment, the apparatus is illustrated in a foam dispenser attached to a squeezable bottle 11 forming a reservoir 10. The apparatus of this embodiment includes a closure 101 in the form of a hollow cylinder having internal threads 13 at its outer end. On top of the cylinder is a frustroconical portion 15 connecting the cylinder to an annular ring portion 17. Extending outwardly from the radially inner part of the annular ring is a cylindrical part 19 extending axially outward. Adjacent to the inner surface annular part 17 is a gasket 102. This embodiment is releasably attached to the bottle 11 by threads 13 in closure 101 with gasket 102 sealing against the top 21 of bottle neck 23. Extending inwardly from annular portion 17 is a housing 104 having a cylindrical side wall 29 and a bottom 31. Bottom 31 terminates in a frustro-conical portion 33 axially inwardly and leading to a cylindrical stem 35. Cylindrical stem 35 receives a dip tube 106 which surrounds stem 35 with an interference fit. A central passage 37 in stem 35 is an inlet passage for fluid entering housing 104. At the top of housing 104 are a plurality of openings 105, placing the housing in communication with the reservoir 10 inside of the bottle 11.

In an embodiment of the invention, closure 101 can be integrated with housing 104 as one piece. In another embodiment, housing 104 and closure 101 can be two detached components that can be assembled together as one piece, for example, by providing complementary threads on each piece. This embodiment is particularly advantageous as it can easily be fitted to different bottle-necks.

Slidably contained within housing 104 is a chamber 107. Chamber 107 has a cylindrical side wall 41, an open outer end 43 (108) and a bottom 45. Bottom 45 has an axially inwardly projecting cylindrical member 47 which is hollow and has a beveled surface 49 at its inner end. Surface 49 seats against the inner surface of frustro-conical portion 33 to form an inlet valve for housing 104. In the position shown, with inlet valve 111 closed, the bottom 45 of chamber 107 is spaced from bottom 31 of housing 104. An opening 110 is formed in bottom 45.

A stopper 103 of generally annular shape is press-fit onto the outer open end of chamber 107. The outside of its outer end includes a tapered portion 51. The inside of cylindrical side wall 29 at its axial inner end also includes a tapered portion 53. As will be described in more detail below, these surfaces form an air inlet valve 113 (or air-flow path) from outside to reservoir 10, when the apparatus is in the position shown. As will be discussed below, the inlet valve 113 closes by axial outward movement of chamber 107 when the apparatus is pressurized to dispense foam.

Chamber 107 receives a filter element (not shown) in area 109. Filter element provides the necessary surface area for combining foamable liquid and air which enter chamber 107 through inlet opening 110. The filter element can include gauze or other similar material adapted to provided the required surface area for mixing foamable liquid and air. At column 3, lines 10–22, U.S. Pat. No. 3,937,364 to Wright which is incorporated herein by reference for background information, discloses various porous material suitable for providing tortuous paths for intimate mixing of foamable liquid and air. Exemplary non-compressible porous material include foraminous volcanic glass material, sintered glass material or non-compressible plastic such as porous polyethylene, polypropylene, nylon and rayon. In addition, two mesh screens (not shown) can be placed at both ends of chamber 107. The screen meshes impede the flow through the chamber 109 and create a relatively large pressure drop across the two ends of the chamber. This pressure drop causes chamber 107 to slide within housing 104. This is a significant event in contrast with the prior art as it causes chamber 107 to slide within housing 104.

Inlet opening 110 in bottom 31 of chamber 107 is open to the space between bottom 31 of chamber 107 and bottom 45 of housing 104 and is the point where foamable liquid and air enter the chamber from dip tube 106 and reservoir 10.

A cap 20 surrounds the axial outer end of housing 104. The cylindrical part 19 of housing 104 receives an inwardly extending annular portion 22 of cap 20. Annular portion 22 is fitted over cylindrical part 19 for sliding axially thereon. Cap 20 also has formed thereon a recessed portion 24 and connecting side walls 25 that define a flow path for foam exiting mixing area 109. Cap 20 also includes nozzle 112 extending therefrom and in communication with the space above chamber 107. The axial inner end of cap 20 is cylindrical and surrounds the axial outer end of closure 101 and is supported thereon for axial sliding motion. It is retained in place by the cooperation of an annual radially inwardly projecting flange on the cylindrical inner end and an outwardly projecting flange at the axial outer end of the cylindrical part of the closure 101. Cap 20 includes a stopper 18 that engages the inner surface of cylindrical part 19 of closure 101 at its axial outer end, as cap is pushed axially inward. Cap 20 can be linked optionally with either the housing 104 or the closure 101. Cap 20 can also be closed by sliding down against closure 101. Optionally, cap 20 and housing 101 can be have complementary threads thereby enabling closure of the cap with a screw action.

FIG. 2 illustrates a cross-sectional view of the apparatus while the apparatus is in dispensing use. In operation, the user squeezes the collapsible bottle 11. This forces the liquid up the dip tube 106, through central passage 35 and against beveled portion 49 unseating it to open the inlet valve 111. Simultaneously, air in the overhead space of reservoir 10 is forced through openings 105. Entry of air through inlets 105 combined with fluid pressure traveling through dip tube 106 and cylindrical stem 35 slides chamber 107 axially outward within housing 104. The movement of chamber 107 within housing 104 closes the air inlet valve 113 formed between tapered portions 51 and 53 to prevent escape of air therefrom. In this manner, reservoir air is forced through openings 105 to inlet 110 as schematically shown with arrow 301. Entry of foamable liquid through inlet 110 and into filter area 109 is schematically shown with arrow 302. Foamable liquid 302 and air 301 enter chamber 107 and form foam in filter or packing material (not shown) housed in space 109. Foam exits chamber 107 through an opening formed between distal end 27 of cylindrical part 19 and connecting side walls 25. In the embodiment of FIGS. 1 and 2, foam is dispensed through nozzle 112.

When the bottle is released, collapsible walls of bottle 11 return to their original shape to create a relative vacuum inside the bottle as compared to the ambient pressure. In the case where the reservoir is made from plastic, the plastic can have enough molded-in memory to create a force sufficient to replenish reservoir 10 quickly. The low pressure within the bottle draws the chamber 107 back into position shown in FIG. 1. Once chamber 107 slides back to the FIG. 1 position the cylindrical member 47 seals against frusto-conical segment 33 to close valve 111. The liquid flow is shut off and the dip tube remains full of foamable liquid. The return of chamber 107 to the position of FIG. 1 also causes tapered portions 51 and 53 to separate, opening a pathway of ambient air to refill reservoir 10. This is a relatively large pathway above the chamber assembly and enables ambient air to replenish the reservoir quickly and completely. Influx of air into the bottle 11 ceases once the pressure inside the bottle reaches an equilibrium with the outside. While the influx of air may cease once the reservoir is replenished, the air-flow path remains open until the bottle is squeezed or otherwise pressurized. Finally, any foam that had occupied the dispensing passage would gradually condense to form liquid. Since the replenishing ambient air travels via nozzle 112, any residual foam contained in the passages is first drawn back into the reservoir.

It should be noted that the present invention is particularly advantageous over the conventional foam dispensers discussed above, among other reasons, for its ability to quickly and completely replenish the air in the reservoir. As briefly discussed in the Background section, the conventional hand-held squeeze bottles fail to properly replenish the air inside the reservoir. This causes the subsequent operations to have incomplete air/foam ratio. As a result, the foam quality degrades with subsequent operations. The present invention overcomes this deficiency by providing a relatively large and unobstructed air-flow path that can replenish or vent the reservoir bottle quickly and completely to preserve foam quality even after many applications.

Foam quality can be adjusted by changing the stoichiometric ratio of air and foamable liquid. For example, a so-called thick foam can have a higher amount of foamable liquid than air. The foam dispenser of the present invention can be adapted to produce different grades of foam by sizing the liquid channel cross section (for liquid flow control) and the gap between the chamber assembly and the housing (for air flow control). Thus, the size of the air flow-path or the air inlet valve can be adjusted to affect the foam quality. In other words, the path of air into the bottle reservoir 113 can be sized relatively larger (thereby displace a larger volume of air in a unit time) than each of paths 301 and 110.

Figure 3:
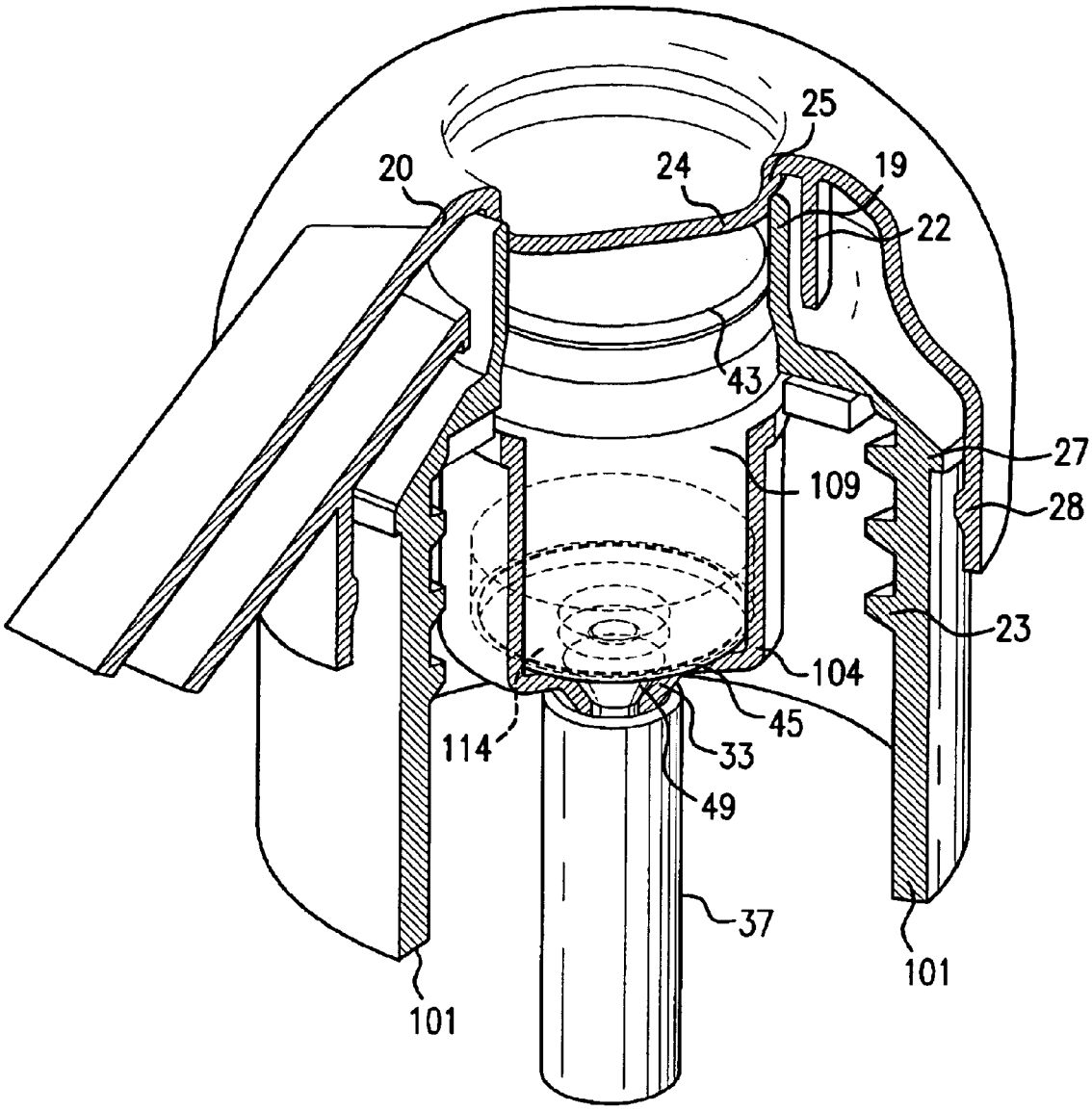
FIG. 3 is a cross-sectional view of the apparatus of FIG. 1 in the closed position.

Pushing down on cap 20 causes annular portion 22 to slide down cylindrical part 19 of hollow cylinder 11 and closes air inlet/foam outlet defined by connecting walls 25 and distal end 27. In one embodiment, cap 20 can be opened from a closed position by squeezing the foam bottle due to surge of foam from surface 108. FIG. 3 is a cross-sectional view of the apparatus of FIG. 1 in the closed position. In this position, cap 20 is pressed downward on cylindrical part 19 of closure 101. In contrast with FIGS. 1 and 2 where distal end 27 rests against flange 28, at the closed position flange 28 is separated from distal end 27. This separation can be formed by pressing cap 20 down, or alternatively, by forming groves (not shown) to define a twist-cap action between cap 20 and closure 101. At the closed position, annular portion 22 of cap 20 engages cylindrical part 19 of housing 104. As compared with the embodiments of FIGS. 1 and 2, it can be readily seen that in this position a greater portion of annular portion 22 engages cylindrical part 19. As discussed with respect to FIG. 1, recessed portion 24 and connecting walls 25 define a flow path for foam exiting mixing area 109. FIG. 3 shows that at the closed position, connecting walls 25 rest against cylindrical part 19 to obstruct fluid emission from outer end 43 of filter 109. Finally, in the closed position, the beveled section 49 of the projecting cylindrical member 47 is shown to be seated against the frustro-conical portion 33, thereby closing the aperture 110. FIG. 3 also shows grooved portions 114 (shown in broken lines) to denote a platform for filter packing material (not shown).

Chamber 107 receives a filter element (not shown) in area 109. Filter element provides the necessary surface area for combining foamable liquid and air which enter chamber 107 through inlet opening 110. The filter element can include gauze or other similar material adapted to provided the required surface area for mixing foamable liquid and air. At column 3, lines 10–22, U.S. Pat. No. 3,937,364 to Wright which is incorporated herein by reference for background information, discloses various porous material suitable for providing tortuous paths for intimate mixing of foamable liquid and air. Exemplary non-compressible porous material include foraminous volcanic glass material, sintered glass material or non-compressible plastic such as porous polyethylene, polypropylene, nylon and rayon. In addition, two mesh screens 140 can be placed at both ends of chamber 107. The screen meshes impede the flow through the chamber 107 and create a relatively large pressure drop across the two ends of the chamber. This pressure drop causes chamber 107 to slide within housing 104. This is a significant event in contrast with the prior art as it causes chamber 107 to slide within housing 104.

Figure 4:
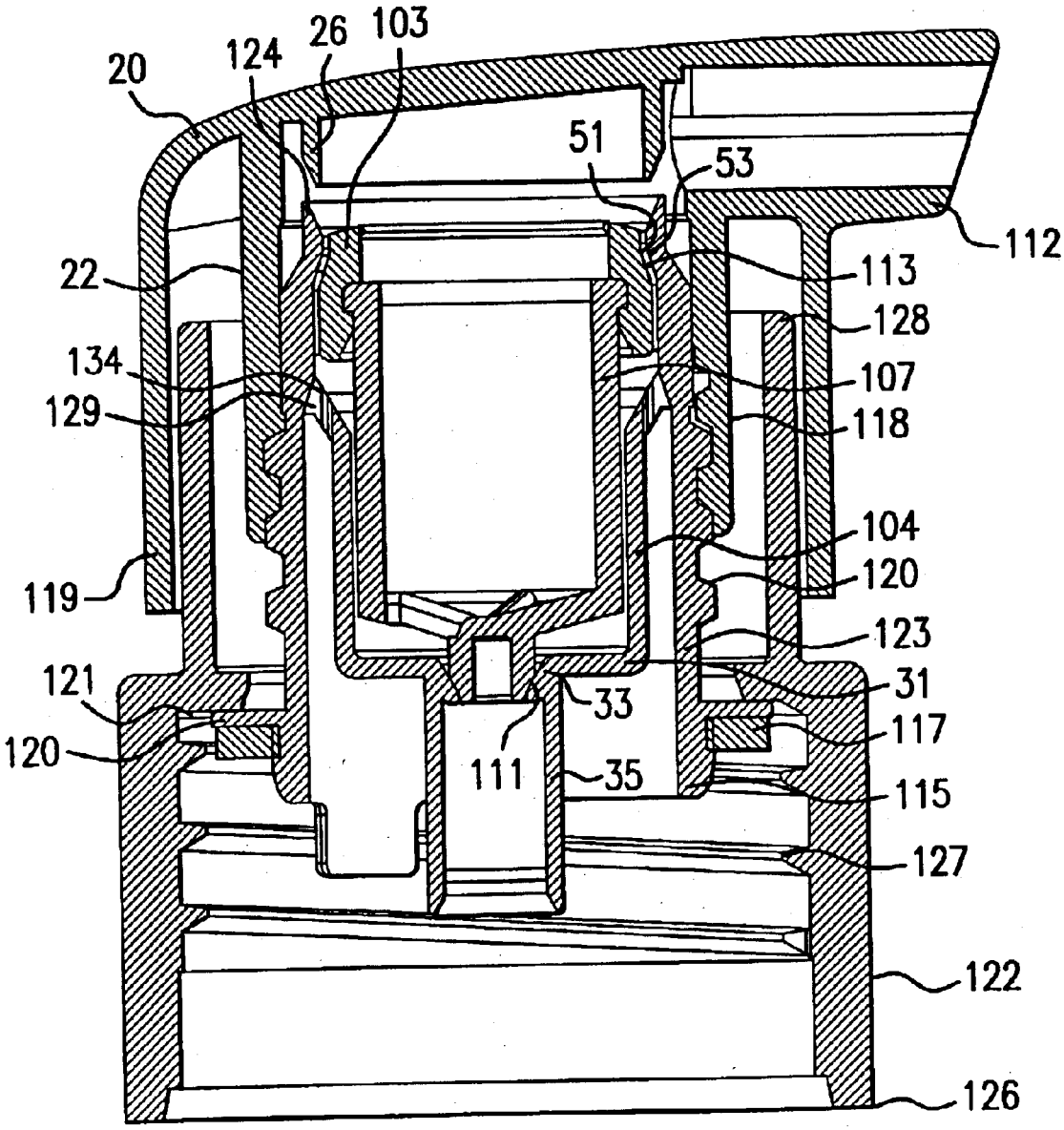
FIG. 4 is a cross-sectional view of an apparatus according to another embodiment of the invention.

FIG. 4 is a cross-sectional view of an apparatus according to another embodiment of the invention. In the embodiment of FIG. 4, assembly 125 is adapted to be engaged to a reservoir (not shown). The assembly 125 includes threaded closure 122 having proximal end 126, distal end 128, threaded portion 127 and flange 121. The threaded portion 127 engages an externally threaded bottle. Flange 121 seats against flange 120 of housing 104. Once assembly 125 is securely engaged to the bottle reservoir (not shown), flange 121 holds housing 104 in place through flange 120. An optional gasket 117 is also provided to seal assembly 125 to the bottle reservoir.

A cap 20 surrounds the axial outer end of housing 104. The cylindrical part 19 of housing 104 receives an inwardly extending annular portion 22 of cap 20. Annular portion 22 is fitted over cylindrical part 19 for sliding axially thereon. Cap 20 also has formed thereon a recessed portion 24 and connecting side walls 25 that define a flow path for foam exiting mixing area 109. Cap 20 also includes nozzle 112 extending therefrom and in communication with the space above chamber 107. The axial inner end of cap 20 is cylindrical and surrounds the axial outer end of closure 101 and is supported thereon for axial sliding motion. It is retained in place by the cooperation of an annual radially inwardly projecting flange on the cylindrical inner end and an outwardly projecting flange at the axial outer end of the cylindrical part of the closure 101. Cap 20 includes a stopper 28 that engages the inner surface of cylindrical part 19 of closure 101 at its axial outer end, as cap is pushed axially inward. Cap 20 can be linked optionally with either the housing 104 or the closure 101. Cap 20 can also be closed by sliding down against closure 101. Optionally, cap 20 and housing 101 can be have complementary threads thereby enabling closure of the cap with a screw action.

In the embodiment of FIG. 4, Chamber 107 is shown without packing material or dip tube. Dip tube (not shown) is engaged to cylindrical stem 35. As in the embodiment of FIG. 1, air replenishes the bottle reservoir through the nozzle 112, in between the gap formed between stopper 103 and the annular side wall 124, through air slots 134 and into the reservoir. FIG. 4 shows the device in an un-actuated position during the air-refill operation.

Figure 5:
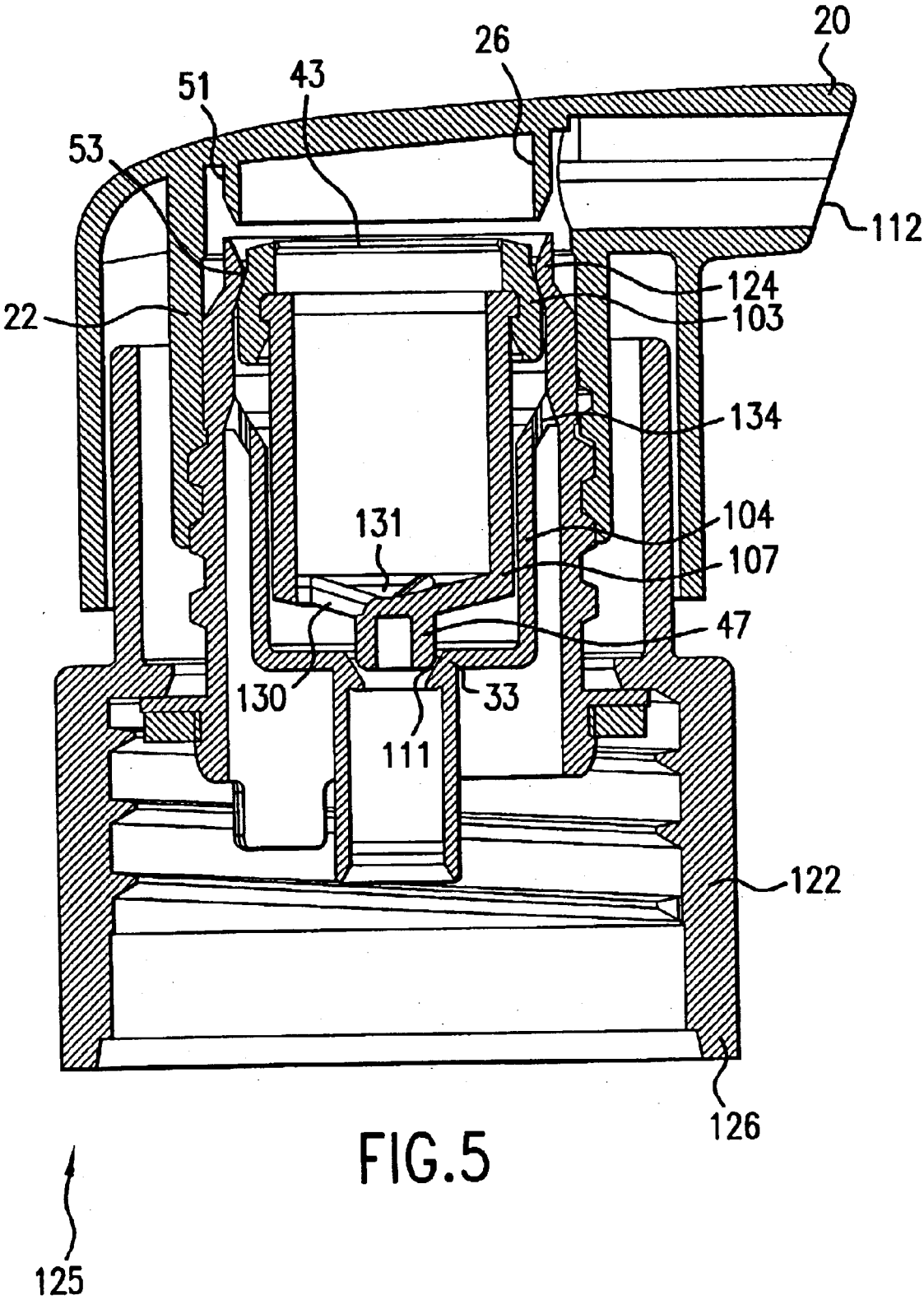
FIG. 5 shows the embodiment of FIG. 4 while the apparatus is in use.

FIG. 5 shows the embodiment of FIG. 4 while the apparatus is in use (that is, when the collapsable bottle is squeezed. As sown in FIG. 5, inlet valve 111 is opened as projecting cylindrical member 47 is unseated from frusto-conical portion 33 of housing 104. Foamable liquid and air enter housing 104 though space 131 formed between spokes 130. At the same time air from the overhead space of the reservoir bottle enters the chamber from the proximal end 126, traveling through slot 134 and inbetween housing 104 and chamber 107 and enters chamber 104 through spaces 131. Air is forced in-between the outer walls of chamber 107 and the inner periphery of housing 104 to be combined with the liquid that is concurrently forced up via the dip tube. Open inlet 111 enables foamable liquid to enter from the bottle reservoir through dip tube (not shown). It can also be seen in FIG. 5 that inlet valve 113 (see FIG. 1), formed between tapered portions 51 and 53, is closed to prevent escape of air therefrom. Instead, air is forced to mix with foamable liquid in the packing material contained in chamber 107. Foam exits at the open outer end 43. Annular closure in the form of lip 26 protrudes from cap 20 and delimit the foam flowing through the nozzle 112. Because annular threaded portion 22 seals against the annular side wall 124, foam is forced out through nozzle 112.

Figure 6:
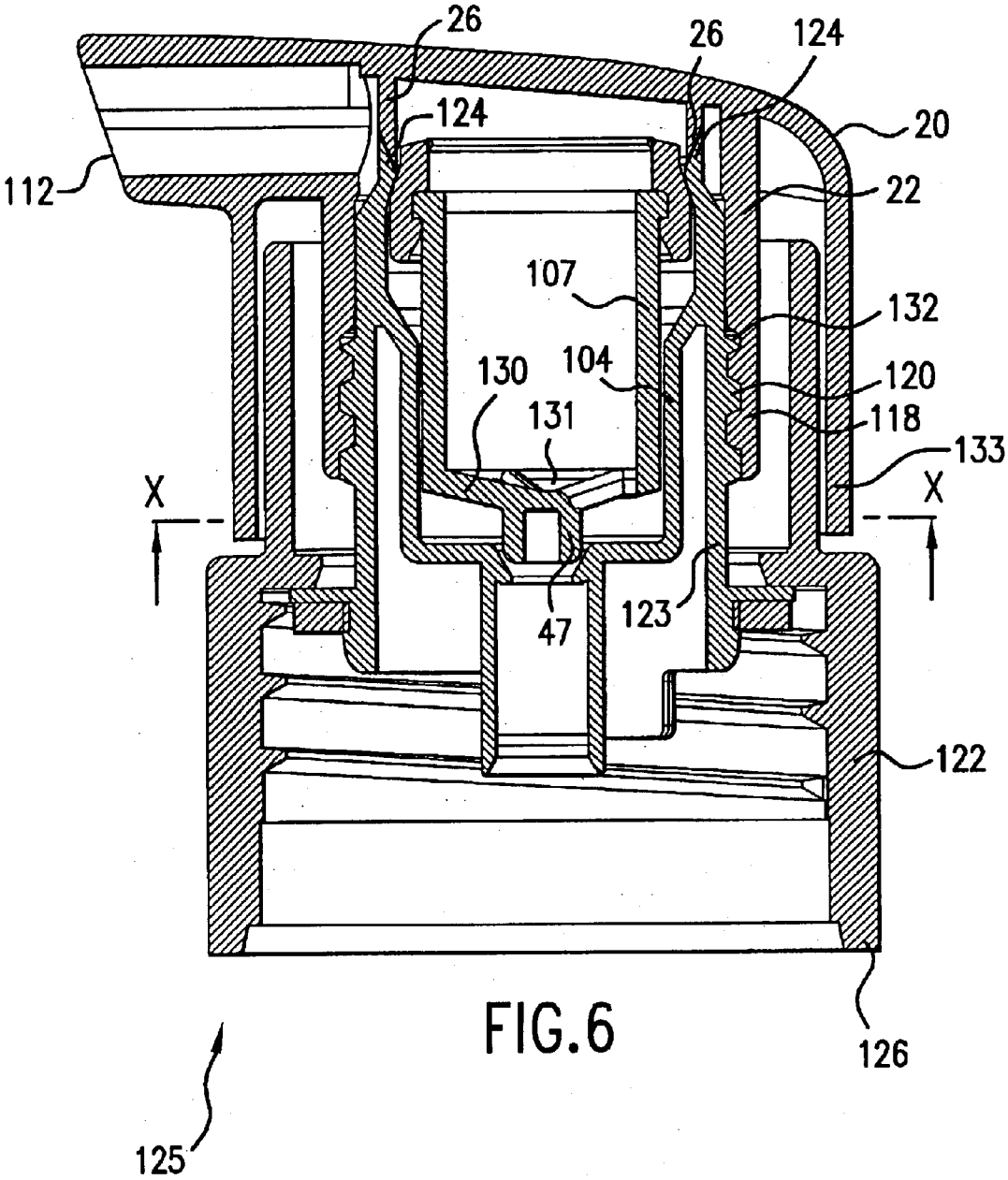
FIG. 6 is a cross-sectional view of an apparatus according to another embodiment of the invention with the cap in the closed position.

FIG. 6 is a cross-sectional view of an apparatus according to another embodiment of invention, showing cap 20 in the closed position. As shown in this embodiment, cap 20 is lowered such that the proximal end of lip 26 sealingly rests against distal end of the annular side wall 124. Thus, contents of the bottle reservoir can not escape. In one embodiment, assembly 125 includes a twist-lock system where clockwise rotation of cap 120 with respect to the rest of assembly 125 engages lip 26 to annular side walls 124. The locking mechanism can be activated through clockwise rotation of 90 or 180 degrees of cap 20 with respect to assembly 125. Counter clockwise rotation at can disengage the cap from the rest of the assembly 125.

Figure 7:
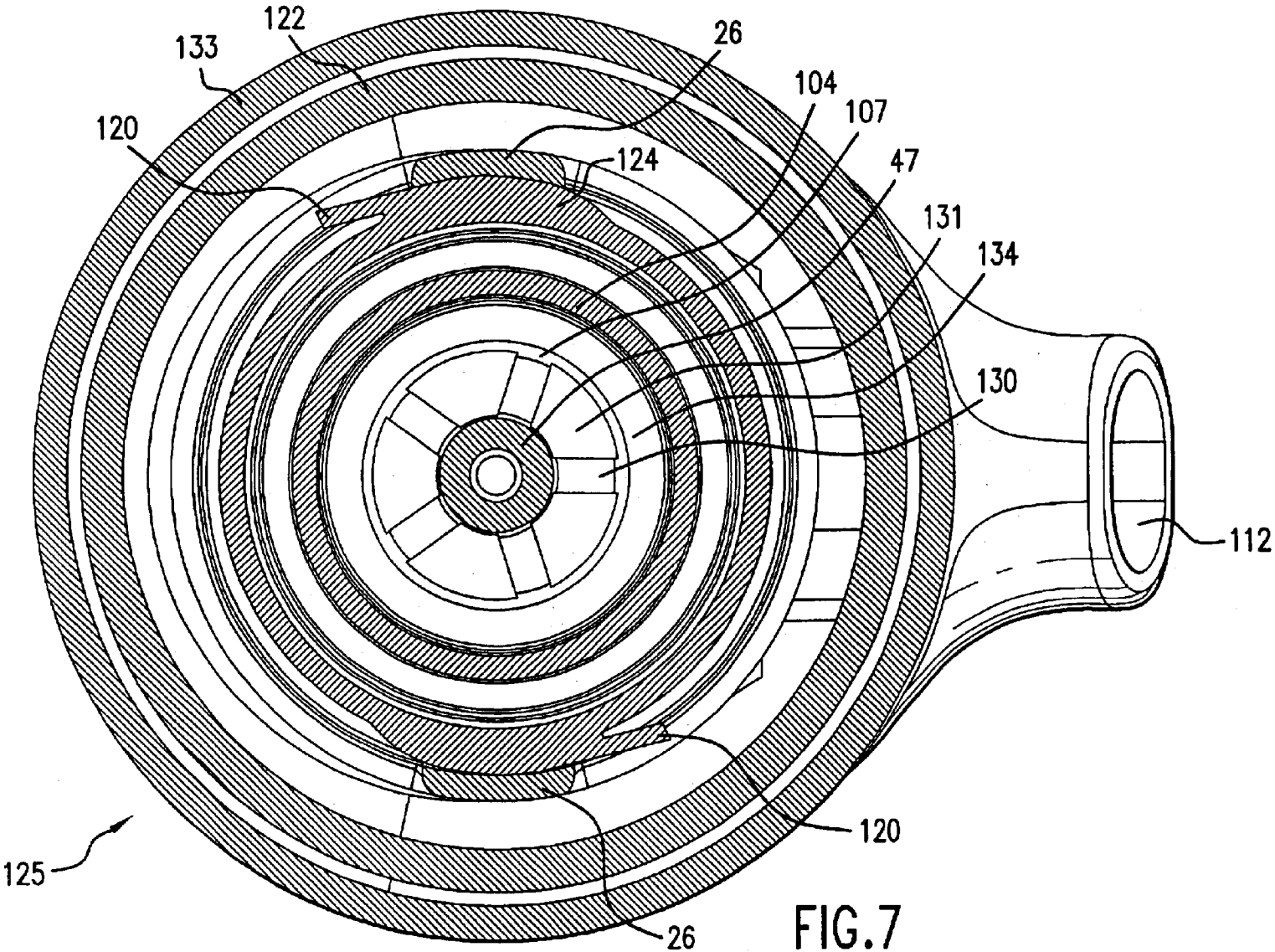
FIG. 7 is a cross-sectional view of FIG. 6 about the axis.
Figure 8:
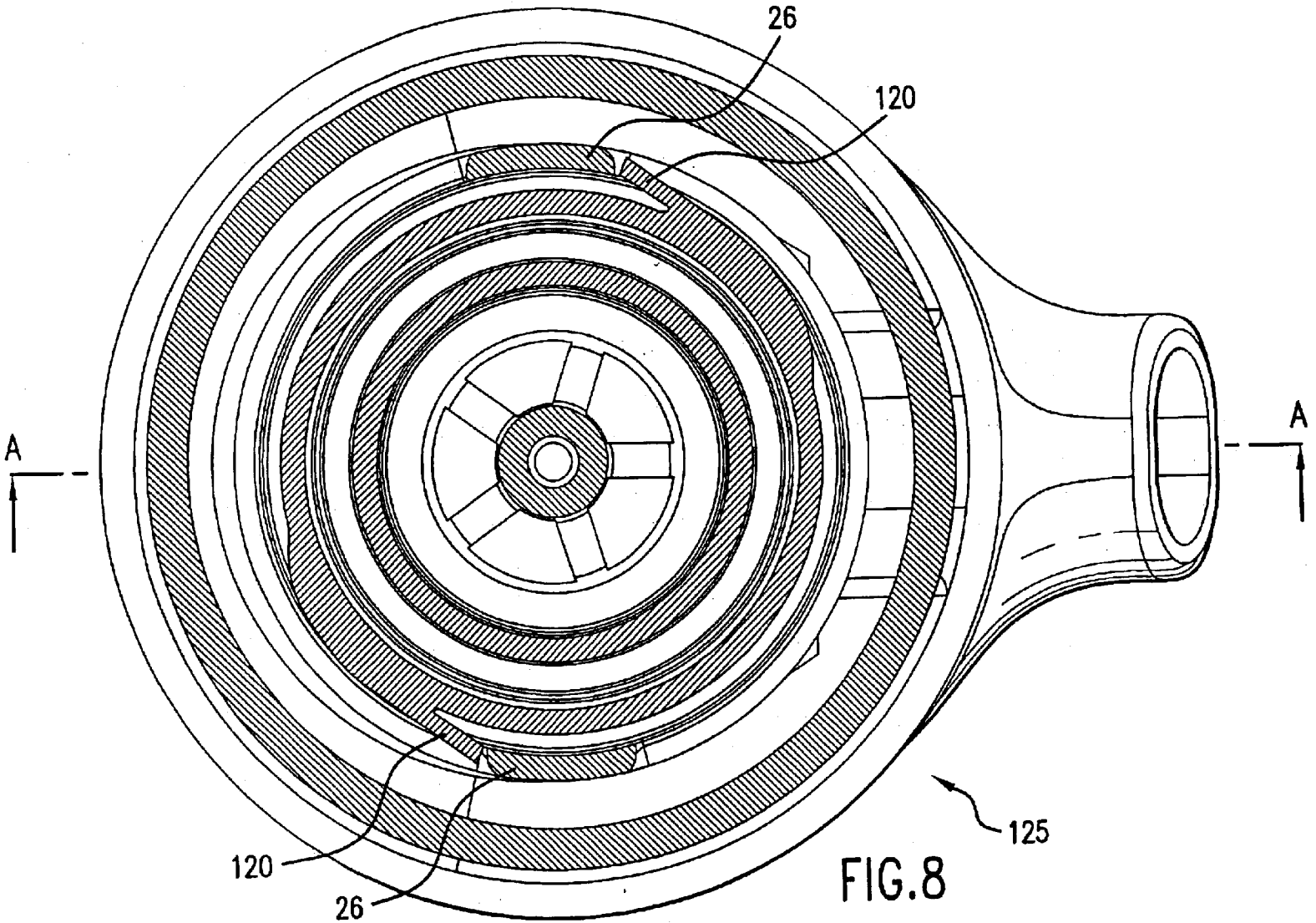
FIG. 8 shows the embodiment of FIG. 7 in the engaged position.

FIG. 7 is a cross-sectional view of FIG. 6 about the X-axis. FIG. 6 shows projecting cylindrical portion 47 radially connected to chamber 107 via spokes 130. The spaces 131 allow for fluid entry into chamber 107. Moving radially outward from chamber 107, is housing 104. It can be readily seen from the embodiment of FIG. 7 that gap 134 allows between chamber 107 and housing 104. Gap 134 enables air to enter chamber 107 from the reservoir (see above discussions concerning entry of air into chamber 107). The twist-lock mechanism discussed with respect to FIG. 6 is shown through stopper 120 and lip 26. In the embodiment of FIG. 7 the twist-lock mechanism is not engaged. Stoppers 120 can be formed on the annular side walls 124 of housing 104. FIG. 8 shows external annular portions 133 (cap 20 in FIG. 6) rotated clockwise such that stoppers 120 engage lip 26. In the engaged position cap is locked in place and cannot be easily disengaged from assembly 125. Disengaging the cap in FIG. 7 requires releasing stopper 120 by, for example, pressing stoppers 120 away from lip 26. The cap can be unlocked from the engaged position by twisting the cap in a counter clockwise rotation with respect to the assembly 125.

The reservoir can be constructed from conventional re-formable and flexible plastics. Similarly, chamber 107 and housing 104 can be made of suitable plastic or non-plastic material. In the embodiments of FIGS. 1 and 2, housing 104 is threaded to a reservoir bottle and a dip tube with a gasket 102 interposed between the bottle and closure 101. Gasket 102 prevents leakage of formable fluid from the reservoir bottle 11. According to one embodiment of the invention, housing 104 and chamber 107 can be formed integrally as a unit construction for later assembly to a reservoir.

While not shown in the exemplary embodiments, the foam dispensing apparatus of the invention can be used with reservoirs other than a squeeze bottle. That is, although shown in an embodiment where pressure is generated by a squeezing a bottle, the disclosed arrangement may also be used with other embodiments were different sources of pressure are used. For example, a small hand-pump or a bellow can be coupled to the bottle to provide the desired internal pressure. Thus, it will be understood by one of ordinary skill in the art that such modification to the exemplary embodiments disclosed herein will not deviate from the inventive concept and will be considered within the scope of the claimed invention.

What is claimed is:

1. A foam dispensing apparatus comprising:

a housing having a first inlet and a second inlet, said housing also having a plurality of openings;

a chamber, having an inlet opening and an outlet opening, disposed within said housing, for sliding movement between a first position in which said chamber seals against and closes said first inlet while opening said second inlet and a second position in which said chamber opens said first inlet and seals against said housing to close said second inlet, a space between said chamber and housing forming a passage from said plurality of opening in said housing to said opening in said chamber, said first inlet also being in communication with said passage when said first inlet is open;

material housed within the chamber to provide surface area for mixing a foamable liquid and air to produce foam; and an outlet from said housing in communication with said chamber outlet.

2. The apparatus of claim 1 further including a compressible reservoir for containing the foamable liquid with an air space above the foamable liquid, passages placing the liquid in communication with said first inlet and passages placing the air space in communication with said second inlet, and with said openings in said housing.

3. The apparatus of claim 2 the chamber and the housing defining a first path for communicating a foamable liquid from the reservoir to the chamber under a first pressure, the chamber and the housing defining a second path for communicating air from the reservoir to the chamber under the first pressure, the chamber and the housing defining a third path for communicating ambient air into the reservoir under a second pressure.

4. The apparatus of claim 1, wherein the second inlet is sized to provide unobstructed communication of ambient air into the reservoir.

5. The apparatus of claim 3, wherein the second inlet is sized relatively larger than each of the first path and the second path.

6. A foam dispenser comprising:

a chamber, a housing and a reservoir for communicating a foamable liquid and air to said chamber and said housing, a first aperture for influx of said formable liquid from the reservoir, said first aperture defined by said chamber and said housing, a second aperture for influx of air from the reservoir, said second aperture defined by said chamber and said housing, a third aperture coupled to said reservoir for influx of ambient air into said reservoir, a first mesh screen and a second mesh screen positioned within the chamber, and an outlet.

7. The foam dispenser of claim 6, wherein said third aperture is substantially larger than said first or said second aperture.

8. The foam dispenser of claim 6, further comprising packing material having a plurality of tortuous paths to mix air and foamable liquid.

9. The foam dispenser of claim 6, further comprising a dip tube.

10. The foam dispenser of claim 6, further comprising a cap.

11. A method for mixing at least two fluids comprising:

sliding a chamber within a housing to a first position to form a first aperture and a second aperture between said housing and said chamber, said first aperture communicating a foamable liquid from a reservoir to said chamber and said second aperture communicating air from said reservoir to said chamber;

mixing said foamable liquid and air to produce foam;

dispensing said foam from the chamber; and sliding said chamber within said housing to a second position to form a third aperture between said housing and said chamber to replenish said reservoir with ambient air.

12. The method of claim 11, wherein the step of mixing said foamable liquid and air further comprises passing said foamable liquid and air through a tortuous path to produce foam.

13. The method of claim 11, wherein the step of mixing said foamable liquid and air further comprises passing said foamable liquid and air through a first and a second mesh filters to produce foam.

14. The method of claim 13, further comprising controlling the foam quality by adjusting the size of each of said first and said second aperture relative to each other.

15. A foam producing apparatus comprising:

a closure;

a housing disposed within said closure, said housing having an inlet and an outlet;

a chamber disposed within said housing for sliding movement from a first position in which said chamber seals against a first inlet and opens a second inlet and a second position in which said chamber opens said first inlet and seals against said second inlet;

a first path between said housing and said closure when said chamber is in said first position; and a second path and a third path between said housing and said chamber when the chamber is in the second position.

16. A foam dispenser comprising:

a reservoir bottle having collapsible walls;

a closure coupled to said reservoir bottle;

a housing disposed with said closure, said housing having an inlet and an outlet;

a chamber disposed within said housing for sliding movement from a first position in which said chamber seals against a first inlet and opens a second inlet and a second position in which said chamber opens said first inlet and seals against said second inlet;

a first path between said closure and said reservoir bottle when said chamber is in said first position; and a second path and a third path between the housing and the chamber when the chamber is in the second position.

17. A method for mixing air and foamable liquid to produce foam, the method comprising:

sliding a chamber within a housing to a first position to define a first path and a second path between said housing and said chamber, said first path communicating a foamable liquid to said chamber and said second path communicating air to said chamber;

mixing said foamable liquid and air to produce foam;

dispensing said foam from the chamber; and sliding said chamber within said housing to a second position, said second position sealing first and said second path and forming a third path to replenish the air consumed during mixing.

18. A method for mixing air and foamable liquid to produce foam, the method comprising:

communicating said air and said foamable liquid from a reservoir to a housing;

sliding a chamber within a reservoir to a first position to form a first inlet for receiving said air and said formable liquid from said housing;

mixing said air and said foamable liquid to form foam;

dispensing said foam from said chamber; and sliding said chamber to a second position within said housing, said second position sealing said first inlet and forming a second inlet, the second inlet replenishing said reservoir with ambient air.

* * * * *